United States Patent [19]

Evans

[11] Patent Number: 4,878,810

[45] Date of Patent: Nov. 7, 1989

[54] TURBINE BLADES HAVING ALTERNATING RESONANT FREQUENCIES

[75] Inventor: David H. Evans, Lake Mary, Fla.

[73] Assignee: Westinghouse Electric Corp., Pittsburgh, Pa.

[21] Appl. No.: 196,691

[22] Filed: May 20, 1988

[51] Int. Cl.[4] ..... F01D 5/10

[52] U.S. Cl. ..... 416/203; 416/175; 416/228; 416/500

[58] Field of Search ..... 416/203, 228, 175, 500; 415/119, 172 A

[56] References Cited

U.S. PATENT DOCUMENTS

| | | | |
|---|---|---|---|
| 1,639,247 | 8/1927 | Zoelly et al. | 416/190 |
| 2,575,710 | 11/1951 | Hardigg | 415/119 X |
| 2,915,279 | 12/1959 | Chamberlin | 416/228 |
| 2,916,258 | 12/1959 | Klint | 416/203 |
| 2,948,506 | 8/1960 | Glasser et al. | 415/119 |
| 3,006,603 | 10/1961 | Caruso et al. | 415/119 |
| 3,347,520 | 10/1967 | Owczarek | 415/119 |
| 3,536,417 | 10/1970 | Stiefel et al. | 416/203 X |
| 4,097,192 | 6/1978 | Kulina | 416/175 |
| 4,274,806 | 6/1981 | Gallardo | 415/172 A |
| 4,732,532 | 3/1988 | Schwaller et al. | 416/500 X |

FOREIGN PATENT DOCUMENTS

| | | | |
|---|---|---|---|
| 882534 | 7/1953 | Fed. Rep. of Germany | 416/228 |
| 1087745 | 8/1960 | Fed. Rep. of Germany | 416/228 |
| 1177277 | 9/1964 | Fed. Rep. of Germany | 416/203 |
| 150903 | 8/1984 | Japan | 416/203 |
| 957393 | 5/1964 | United Kingdom | 416/203 |
| 324889 | 5/1984 | U.S.S.R. | 416/203 |

*Primary Examiner*—Everette A. Powell Jr.

[57] ABSTRACT

Within a rotor blade row of a steam turbine, rotor blades having one resonant frequency alternate with rotor blades having a second, different resonant frequency. The two different resonant frequencies are achieved by profiling the tips of every other rotor blade.

6 Claims, 2 Drawing Sheets

FIG. 1
(PRIOR ART)
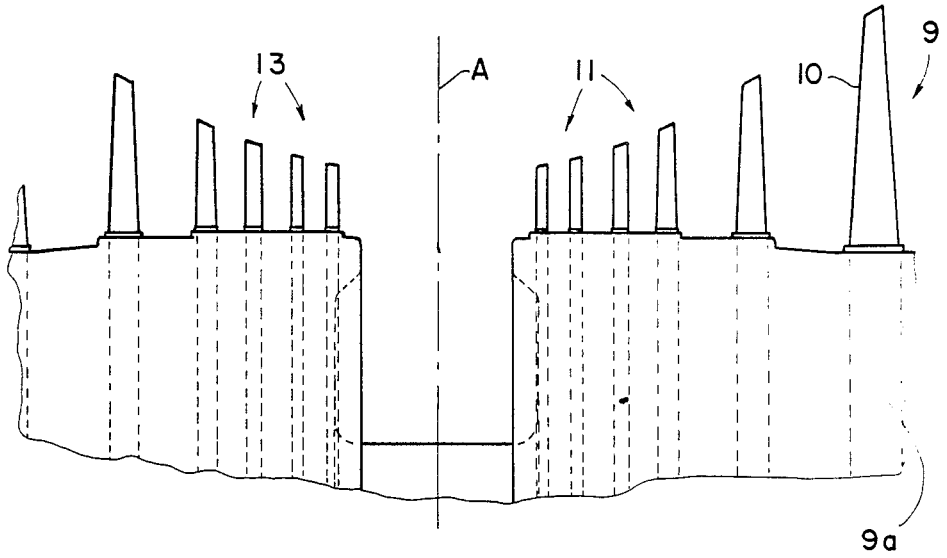
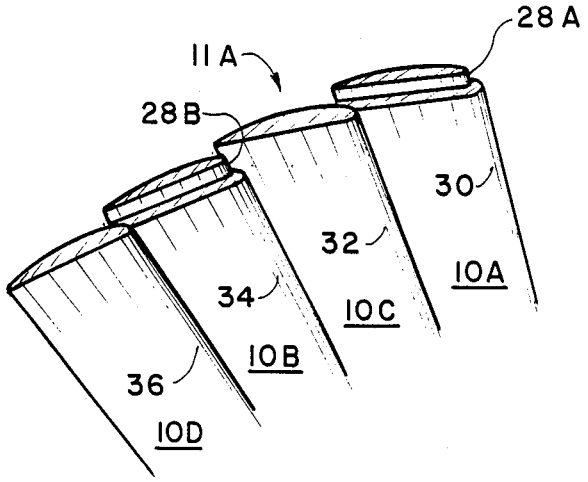
FIG. 8

FIG. 2
(PRIOR ART)
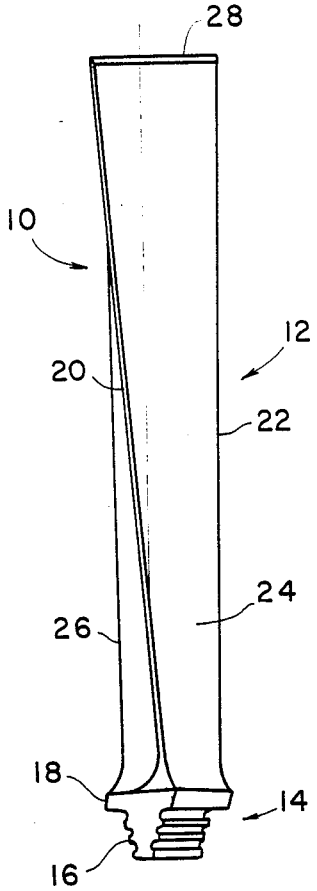
FIG. 3
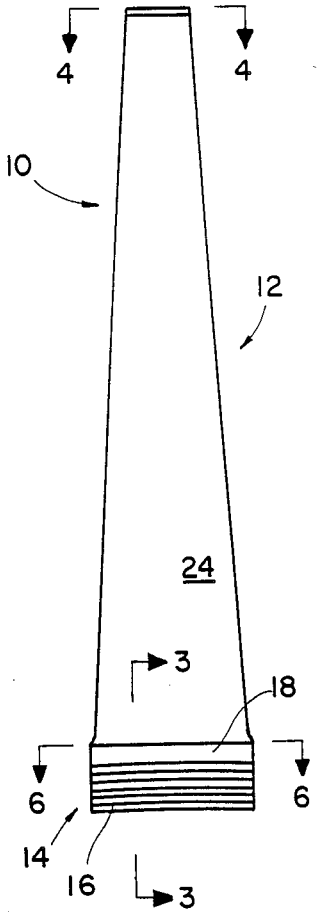
FIG. 4
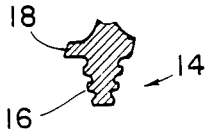
FIG. 6
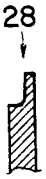
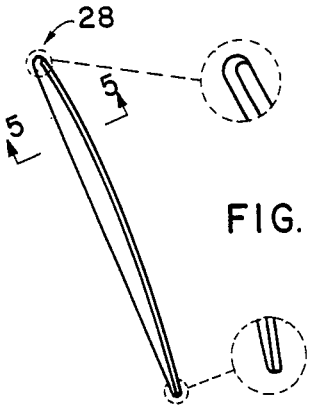
FIG. 5
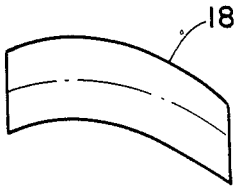
FIG. 7

TURBINE BLADES HAVING ALTERNATING RESONANT FREQUENCIES

BACKGROUND OF THE INVENTION

1. Field of the Invention

The present invention relates generally to turbine rotor blades and, more particularly, to turbine rotor blade rows having blades with two alternating resonant frequencies and a method for preventing unstalled flutter employing the same.

A steam turbine rotor has several rows of rotor blades. Although rotor blades typically share the same general shape, that is, each typically has a base portion and an airfoil portion including a leading edge, a trailing edge, a concave surface, and a convex surface, the airfoil shape common to a particular row of rotor blades differs from the airfoil shape for every other row within that turbine. Likewise, no two turbines of different designs share the same airfoil shape. The structural differences in airfoil shape, which may appear minute to the untrained observer, result in significant variations in aerodynamic characteristics, stress patterns, operating temperature, and natural frequency of the airfoil. In the process of designing and fabricating rotor blades, it is critically important to tune the resonant frequency of the blades to minimize forced vibration. Blade tuning for steam turbines powered by fossil fuels first requires a determination of the harmonics of running speed. In a typical fossil steam turbine, the rotor rotates at 3,600 revolutions per minute (r.p.m.), or 60 cycles per second (c.p.s.). Since 1 c.p.s.=1 hertz (Hz), and since simple harmonic motion can be described in terms of the angular frequency of circular motion, the running speed of 60 c.p.s. produces a first harmonic of 60 Hz, a second harmonic of 120 Hz, a third harmonic of 180 Hz, a fourth harmonic of 240 Hz, etc. The harmonic series represents the characteristic frequencies of the normal modes of vibration of an exciting force acting upon the rotor blades. If the rotor blade natural frequencies of oscillation coincide with the frequencies of the harmonic series, or harmonics of running speed, a destructive resonance can result. It is standard practice in the art to tune the natural resonant frequencies of the rotor blades of a blade row to a frequency at a midpoint between two successive harmonics, such as 210 Hz, which is midway between the third and fourth harmonics. In a nuclear powered steam turbine, operating speed is 1800 r.p.m. Therefore, successive harmonics would be at 30 Hz, 60 Hz, 90 Hz, etc. Combustion turbines also experience flutter, and must be similarly tuned to avoid dangerous frequencies.

Selection of the two successive harmonics between which the blades are tuned depends on the particular blade. For example, some blades may have a naturally higher or lower frequency due to the length, shape, or some other parameter. While it is most desirable to have the natural resonant frequency of the blades fall exactly between two harmonics, it may be difficult to achieve a midway frequency given the other design parameters of the blade. In other words, there may be limits to the amount by which a practitioner can raise or lower the frequency of a blade without adversely affecting performance.

When all of the rotor blades of a row have the same natural resonant frequency, and when that frequency is at or near the midpoint between two successive harmonics of running speed, the effects of forced vibration are minimized. Forced vibration is generated by disturbances in the steam flow, and the frequency is expressed as the harmonics of running speed. It is standard practice to tune an entire row of blades to the same natural resonant frequency which is as close as possible to the midpoint of two harmonics of running speed.

In contrast to forced vibration, an aerodynamic phenomenon known as unstalled flutter may occur even if the blades are tuned properly between two harmonics of running speed. Unstalled flutter is a self excitation of the blades which may occur when blades having the same natural resonant frequency vibrate at a frequency close to their natural resonant frequency for the first mode of vibration. A "mode" of vibration refers to a direction of vibration, given that a blade can vibrate in a plurality of directions. The first mode of vibration is that which occurs predominantly in the direction of rotation of the blade. A blade will have a natural resonant frequency for each mode of vibration. Unstalled flutter occurs when two or more adjacent blades of a row move relative to each other in a certain phase relationship and vibrate at a frequency close to their natural frequency for the first mode.

Unstalled flutter is a problem which confronts a variety of types of rotor blades for fossil and nuclear steam turbines and combustion turbines. The occurrence of unstalled flutter places an unacceptable stress on the blades which may lead to blade failure. In a steam turbine, the last three stages of a low pressure steam turbine are believed to be more susceptible to flutter since these blades are "free standing". Lashing blades together tends to militate against unstalled flutter since it is less likely that blades will move relative to each other.

A need exists for an effective Way of preventing the occurrence of unstalled flutter for free standing turbine rotor blades.

SUMMARY OF THE INVENTION

An object of the invention is to prevent unstalled flutter of rotor blades in a blade row of a turbine rotor.

Another object of the invention is to prevent unstalled flutter of free standing rotor blades.

Yet another object of the invention is to prevent self-excited vibration between adjacent rotor blades of a blade row without increasing the effects of forced vibration.

Another object of the invention is to prevent flutter in fossil steam turbines, nuclear steam turbines, and combustion turbines by alternating resonant frequencies of rotor blades between two predetermined frequencies.

In a preferred embodiment described herein, a turbine rotor assembly includes a rotor rotatable at a predetermined running speed, a plurality of first rotor blades, each having a first resonant frequency, a plurality of second rotor blades, each having a second resonant frequency, each of the plurality of first and second rotor blades having a base portion and an airfoil portion including a leading edge, a trailing edge, a concave surface, a convex surface, and a tip, wherein the plurality of first and second rotor blades are alternatingly connected to the rotor in at least one radial row, and wherein adjacent blades of the at least one row have alternating resonant frequencies. Preferably, the difference in resonant frequencies is achieved by providing either the first or second rotor blades with a profiled tip in which mass is removed from the tip by machining in an axial direction along the tip from the leading edge to the trailing edge.

For a fossil steam turbine having running speed of 3600 r.p.m., or 60 c.p.s., a harmonic series of frequencies is generated in which the first harmonic is 60 Hz, the second harmonic is 120 Hz, the third harmonic is 180 Hz, the fourth harmonic is 240 Hz, etc. The blades are tuned to a frequency approximately midway between two successive harmonics, and then every other blade is re-tuned to a different resonant frequency. The difference between the two frequencies is relatively small, yet the result is to effectively reduce the probability of experiencing unstalled flutter.

These and other features and advantages of the rotor blades having two different alternating frequencies and method of preventing unstalled flutter of the invention will become more apparent with reference to the following detailed description and drawings.

BRIEF DESCRIPTION OF THE DRAWINGS

FIG. 1 is a partial cross-section of a known steam turbine rotor with rotor blades.

FIG. 2 is a front elevation view of a known rotor blade having a profile tip;

FIG. 3 is a side view of the rotor blade of FIG. 2;

FIG. 4 is a cross-sectional view taken along line 3—3 of FIG. 3;

FIG. 5 is a cross-sectional view taken along line 4—4 of FIG. 3;

FIG. 6 is a cross-sectional view taken along line 5—5 of FIG. 5;

FIG. 7 is a cross-sectional view taken along line 6—6 of FIG. 3; and FIG. 8 is a partial, detailed perspective view showing alternating tip profiles according to a preferred embodiment of the present invention.

DETAILED DESCRIPTION OF THE PREFERRED EMBODIMENTS

Referring to FIG. 1, a known steam turbine rotor assembly 9 includes a rotor **9*a* and a plurality of rows 11 of rotor blades; in FIG. 1, one blade of each row 11 is visible. It is understood that the rotor 9*a* is substantially cylindrical and each row 11 lies in a different plane transverse the longitudinal axis of rotor 9*a*. Each row 11 is paired with a row 13 on the opposite side of a transverse symmetry plane illustrated by broken line A, thereby forming matched pairs of rows. Rotor blade 10 is one of as many as 120 blades which extend radially outwardly from the rotor 9*a* in a particular row 11**.

Referring now to FIGS. 2–7, the rotor blade 10 has an air foil portion 12 and a base portion 14. The base portion 14 includes a root 16 and platform 18. The root 16 is received in a mounting groove of the rotor **9*a*. The platform 18 abuts an outer surface of the rotor 9*a* and supports the air foil portion 12. The air foil portion 12 includes a leading edge 20, a trailing edge 22, a concave surface 24, a convex surface 26, and a tip 28**.

The general features of the rotor blade 10 described above do not form a part of the present invention, although it should be noted that most, if not all, steam turbine rotor blades have essentially the same features, except that the exact length, shape, and dimensions vary according to the design parameters of a particular steam turbine. The rotor blade 10 illustrated in FIGS. 2 through 7 is one which is used in a low pressure steam turbine and, in particular, is used in one of the last three stages (rows) of the low pressure turbine.

Rotor blade 10 is one of a plurality of rotor blades which constitute a row of rotor blades. A rotor **9*a* of a steam turbine will have a plurality of rows. While the blades of any given row are identical to each other, the blades of different rows have differences in size and shape which are determined by the design parameters of the turbine. Paired rows (FIG. 1**) are generally the same shape, but oppositely oriented since steam flows from the center outwardly in opposite directions.

It is standard practice to tune all of the blades of a given row to the same resonant frequency, which falls as close as possible to a midpoint between two successive harmonics of running speed. As previously mentioned, the harmonics of running speed for a typical low pressure fossil steam turbine is derived from a running speed of 3600 revolutions per minute, or 60 Hz (cycles per second). Each disturbance in the steam flow generates a successive harmonic beginning with the first harmonic (60 Hz). A variety of tuning techniques has been used in the past to either raise or lower the resonant frequency of the blades of a row to approach the midpoint between two harmonics. The standard practice is to tune all of the blades of a row to one particular frequency such as, for example, 210 Hz, which is the midpoint frequency between the third (180 Hz) and the fourth (240 Hz) harmonics.

In the present invention, the rotor blades of a row have alternating resonant frequencies in order to avoid unstalled flutter. Two alternating frequencies in the present invention are used so that adjacent rotor blades are not resonant at the same frequency and thus, the probability of producing self-excited vibrations such as unstalled flutter is reduced. The difference between the two frequencies does not have to be substantial. For example, if the target midpoint frequency for the rotor blades is 210 Hz, all the blades of a row could be initially tuned to be slightly below the midpoint, and then every other blade could be re-tuned to a frequency slightly higher than the midpoint. To increase the frequency of every other blade, the blade tip 28 is preferably profiled by machining away a portion of the tip 28. Seen in FIGS. 5 and 6, the profiled tip 28 is made by removing mass from the tip 28 of the blade 10. Also, because the tip 28 is thinner, the profiled tip blades are more easily ground when the blades are fitted into a turbine. Grinding is required since the cylinder that surrounds the rotor blade tips has a surface which is cylindrical; at least one corner of the tip of each blade of a row has to be ground in the tip grinding process to conform the shape of the tip to that of the surface of the cylinder. Since the profiled tip has a thinner dimension, less mass will be removed in the tip grinding process and therefor, changes in resonant frequencies due to mass removed in the tip grinding process are minimized. Currently used tuning techniques for tuning free standing steam turbine rotor blades are designed to achieve a uniform resonant frequency within a blade row approximately at the midpoint between two successive harmonics. The present invention uses a profile on every other tip to obtain alternating frequencies within a row.

Referring to FIG. 8, upper end portions 30, 32, 34 and 36 of rotor blades 10A, 10C, 10B and 10D are representative of a blade row 11A employing the present invention. The blade row **11*a* is adapted for use in a rotor assembly 9 as illustrated in FIG. 1. Blades 10A and 10B have one frequency and blades 10C and 10D have another frequency, so that the row 11A is made up of a plurality of blades having alternating frequencies (only four of which are shown in FIG. 8). The blades of the row 11A are identical to each other except that blades 10A and 10B have profiled tips 28A and 28B, respectively. The profiled tips 28A and 28B increase the frequency of blades 10A and 10B over that of blades 1OC and 10D** due to the loss of mass in the tip. In an alternative embodiment of the invention, the tips could all be profiled or un-profiled, and the alternating frequency could be achieved by other means such as, making every other blade slightly shorter. Since a shorter blade has a higher resonant frequency, an alternating frequency is achieved. Other known methods of blade tuning could be used to increase or decrease resonant frequency, so long as the tuning techniques employed result in the formation of two different resonant frequencies which alternate between adjacent blades.

With alternating frequencies, the likelihood of experiencing unstalled flutter is decreased. Unstalled flutter requires relative movement of blades adjacent to each other in a certain direction and with a certain phase relationship. When such conditions exist, the aerodynamic forces reinforce blade motion rather than oppose it. In other words, in order to have unstalled flutter, it is necessary to have some motion of adjacent blades vibrating at a fundamental mode frequency, even though this frequency is not harmonic with the running speed. If adjacent blades have the same first mode natural frequency and are vibrating with a certain phase angle relationship, the relative motion between blades may remain unchanged or increase in amplitude until a blade failure results.

Numerous modifications and adaptations of the present invention will be apparent to those so skilled in the art and thus, it is intended by the following claims to cover all such modifications and adaptations which fall within the true spirit and scope of the invention.

What is claimed is:

1. A steam turbine rotor assembly comprising:

a rotor rotatable at a predetermined running speed, a plurality of first free standing elongated, low aspect rotor blades, each having a first resonant frequency, a plurality of second free standing elongated, low aspect rotor blades, each having a second resonant frequency, wherein the plurality of first and second rotor blades are alternatingly connected to the rotor in at least one row, and wherein adjacent blades of the at least one row have alternating first and second resonant frequencies, each of the plurality of first and second rotor blades having a base portion and an air foil portion including a leading edge, a trailing edge, a concave surface, a convex surface, and a tip, and the tips of the plurality of second rotor blades of the at least one row being profiled for increasing the resonant frequency thereof, said alternating first and second resonant frequencies providing means for preventing unstalled flutter in the at least one row at non-resonant frequencies wherein each profiled tip includes an L-shaped recess formed substantially longitudinally from the leading edge to the trailing edge in the concave surface of the airfoil portion of the blade at the tip, said L-shaped recess defining an extension running from the trailing edge along the top and terminating before the leading edge.

2. A turbine rotor assembly as recited in claim 1, wherein rotation of the rotor at the predetermined running speed produces a series of harmonics, and wherein the first and second resonant frequencies of the first and second rotor blades of the at least one row are in a frequency range approximately centered between two successive harmonics of the series of harmonics.

3. A turbine rotor assembly as recited in claim 1, wherein the at least one row of rotor blades comprises three rows of a low pressure steam turbine.

4. A turbine rotor assembly as recited in claim 3, wherein the plurality of first and second rotor blades are free standing blades.

5. A turbine rotor assembly as recited in claim 2, wherein the first and second resonant frequencies are first mode resonant frequencies in which vibrations occur in the plurality of first and second rotor blades in the direction of rotor rotation.

6. A turbine rotor assembly as recited in claim 1, wherein the predetermined running speed is substantially 3,600 r.p.m.

* * * * *